US007913999B2

(12) United States Patent
Moore

(10) Patent No.: US 7,913,999 B2
(45) Date of Patent: Mar. 29, 2011

(54) RESILIENT BELT SHEET COMPILER WITH MIXED SHEET LENGTH MODE

(75) Inventor: Steven Robert Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/137,824

(22) Filed: Jun. 12, 2008

(65) Prior Publication Data

US 2009/0309290 A1 Dec. 17, 2009

(51) Int. Cl.
*B65H 43/00* (2006.01)
*B65H 29/46* (2006.01)
*B65H 31/26* (2006.01)

(52) U.S. Cl. ..... 271/182; 271/176; 271/220

(58) Field of Classification Search ..... 271/176, 271/182, 177, 207, 220
See application file for complete search history.

(56) References Cited

U.S. PATENT DOCUMENTS

| | | | | |
|---|---|---|---|---|
| 3,385,598 | A * | 5/1968 | Kim | 271/176 |
| 4,575,069 | A * | 3/1986 | Burkhart | 271/186 |
| 5,000,436 | A * | 3/1991 | Holmes | 271/178 |
| 5,064,185 | A * | 11/1991 | Ricciardi | 271/181 |
| 5,172,904 | A * | 12/1992 | Sze et al. | 271/187 |
| 5,439,209 | A * | 8/1995 | Runzi | 271/251 |
| 5,533,719 | A * | 7/1996 | Crowley et al. | 270/52.09 |
| 5,569,016 | A * | 10/1996 | Mokler | 414/793.1 |
| 5,671,920 | A * | 9/1997 | Acquaviva et al. | 271/307 |
| 5,718,176 | A * | 2/1998 | Stephan | 101/483 |
| 5,765,827 | A * | 6/1998 | Gillmann | 271/300 |
| 6,065,746 | A * | 5/2000 | Tranquilla | 271/176 |
| 6,311,971 | B1 * | 11/2001 | Greer et al. | 271/220 |
| 6,409,043 | B1 * | 6/2002 | Fujita et al. | 271/10.03 |
| 6,591,748 | B2 * | 7/2003 | Kerpe et al. | 101/232 |
| 6,776,407 | B2 * | 8/2004 | Lindenmayer et al. | 271/176 |
| 2002/0145246 | A1 * | 10/2002 | Goda et al. | 271/98 |
| 2004/0113354 | A1 * | 6/2004 | Leitz et al. | 271/177 |
| 2004/0252354 | A1 * | 12/2004 | Shimizu | 358/496 |
| 2005/0269765 | A1 | 12/2005 | Widmer et al. | |
| 2007/0228649 | A1 * | 10/2007 | Mizutani et al. | 271/314 |
| 2008/0054551 | A1 * | 3/2008 | Obuchi | 271/220 |

FOREIGN PATENT DOCUMENTS

| | | | |
|---|---|---|---|
| JP | 63112362 | * | 5/1988 |
| JP | 05208772 | * | 8/1993 |

* cited by examiner

*Primary Examiner* — Stefanos Karmis
*Assistant Examiner* — Patrick Cicchino
(74) *Attorney, Agent, or Firm* — MH2 Technology Law Group LLP

(57) ABSTRACT

A system, method, and resulting resilient belt type sheet compiler with a mixed sheet length mode is provided. The device includes a resilient belt transport for sequentially feeding sheets from a sheet inlet to a compiler tray, the compiler tray having a lead edge stop and a trail edge wall. A monitoring means is positioned proximate to the trail edge wall for detecting a lead end and a trail end of sequentially fed sheets from the sheet inlet to the compiler tray. A sheet brake, responsive to the monitoring means detecting a short sheet, selectively stalls the detected short sheet until a lead end of a subsequent sheet is detected by the sensor or subsequent sheets are absent.

8 Claims, 3 Drawing Sheets

RESILIENT BELT SHEET COMPILER WITH MIXED SHEET LENGTH MODE

FIELD OF THE INVENTION

The present invention generally relates to a resilient belt type sheet compiler. More specifically, the present invention relates to a resilient belt type sheet compiler capable of stacking mixed length sheets without a lead end of a subsequent sheet abutting a trail end of a lead sheet.

BACKGROUND OF THE INVENTION

In high volume production printing, a stacking module can typically be used to assemble large stacks of printed material. These stacking modules can serve as an intermediate storage or base configuration for subsequent finishing procedures. Stacking modules are used with a wide range of media types, weights and sizes.

Certain known stacking modules utilize different methods to feed a supplied sheet to a top of the stack of sheets. Vacuum belts can be used to drive the leading edge of a sheet across the stack. The vacuum is then removed to release the sheet and allow it to drop onto the stack. Slotted disks can be used to capture the leading edge of a sheet and then flip the body of the sheet onto the stack. Pinch nips can be used which corrugate the sheet in the direction of sheet travel, allowing the sheet's leading edge to project substantially over the stack. The sheet is thus ejected from the pinch nips onto the stack. For each of the above cited known methods, operational printing rates in excess of 150 pages per minute (ppm) are difficult to achieve while maintaining high reliability. Therefore, a different sheet handling method is desired for printing systems capable of print rates exceeding 150 ppm.

As an alternative, resilient belt compiling technology is a well known method for stacking sheets at high print rates with high reliability. Exemplary resilient belt compilers are practiced by Hunkeler™ and Lasermax/Roll Systems™ cut sheet stacker modules. The resilient belt compiler escorts/feeds a single sheet at a time for deposit on top of the stacker module via a multiplicity of resilient drive members such as o-rings. Each resilient member provides a very low net drive force to the top of the sheet. The incoming sheet is captured between the resilient belts and the top of the stack. The friction coefficient of the belts is sufficiently high to provide a net driving force to the top of the incoming sheet. However, existing instantiations of the resilient belt technology do not permit mixed sheet length compiling.

By way of example, in known fixed sheet length compiling, sheets are driven across the top of the stack by the resilient belts until each sheets lead edge contacts a lead edge stop. At this point, the sheet stalls and the resilient belts slip against the top surface of the sheet in order to drive the sheet into registration on the stack. The lead edge stop is positioned such that the sheet's trail edge just passes a fixed trail edge wall before stopping. This ensures each sheet's trail edge drops below an input delivery plane so that the trail edge does not interfere with the next sheet lead edge.

A problem can occur if this system, method, or apparatus is used to feed mixed length sheets. If a relatively shorter sheet is fed into the stacking module in the known configuration, the lead edge of the shorter sheet abuts against the lead edge stop, while the trail edge is shorter than an inner length of the tray. Accordingly, a subsequent sheet entering the tray by the resilient belt feed will have a lead end thereof abut the trail end of the shorter sheet, thus causing a malfunction. For this reason, fixed sheet resilient belt compilers have been unsuitable for use with mixed length sheets, and such compiling has been unavailable to the consumer.

Current solutions to the problem include simply stacking common length sheets in the fixed length stacking module and inserting the different length sheets at a later time. This solution is unattractive since there are additional stack processing steps and thus additional opportunities for errors and sheet damage.

Thus, there is a need to overcome these and other problems of the prior art and to provide a system, method, and resulting device for mixed sheet length stacking in a resilient belt type stacker module.

SUMMARY OF THE INVENTION

In accordance with the present teachings, a resilient belt sheet compiler is provided.

The exemplary resilient belt sheet compiler can include a resilient belt transport for sequentially feeding mixed sheet lengths from a sheet inlet to a compiler tray, the compiler tray comprising a lead edge stop and a trail edge wall; monitoring means for monitoring a lead end and a trail end of sequentially fed sheets; and a sheet brake, responsive to the monitoring means detecting a short sheet, for selectively stalling the detected short sheet until a lead end of a subsequent sheet is detected by the monitoring means or subsequent sheets are absent.

In accordance with the present teachings, a method of stacking mixed sheet lengths in a resilient belt sheet compiler is provided.

The exemplary method can include providing a monitoring means to monitor a lead end and a trail end of sequentially fed sheets; providing a resilient belt transport for sequentially stacking sheets received from the inlet transport region into a compiler tray, the compiler tray comprising a lead edge stop and a trail edge wall relative to a sheet feed direction; determining a length of a received sheet via the monitoring means; and stalling a sensed short sheet within the compiler tray until a lead edge of subsequent sheet from the inlet transport is detected by the monitoring means at the trail edge wall of the compiler tray.

In accordance with the present teachings a system for managing feed of mixed sheet sizes into a resilient belt sheet compiler is provided.

The exemplary system can include a sheet brake for stalling a select size sheet within a compiler tray in a feed direction in response to detection of the select size sheet, the stalled sheet having a trail end substantially aligned with a trail edge wall of the compiler tray.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Figure 1:
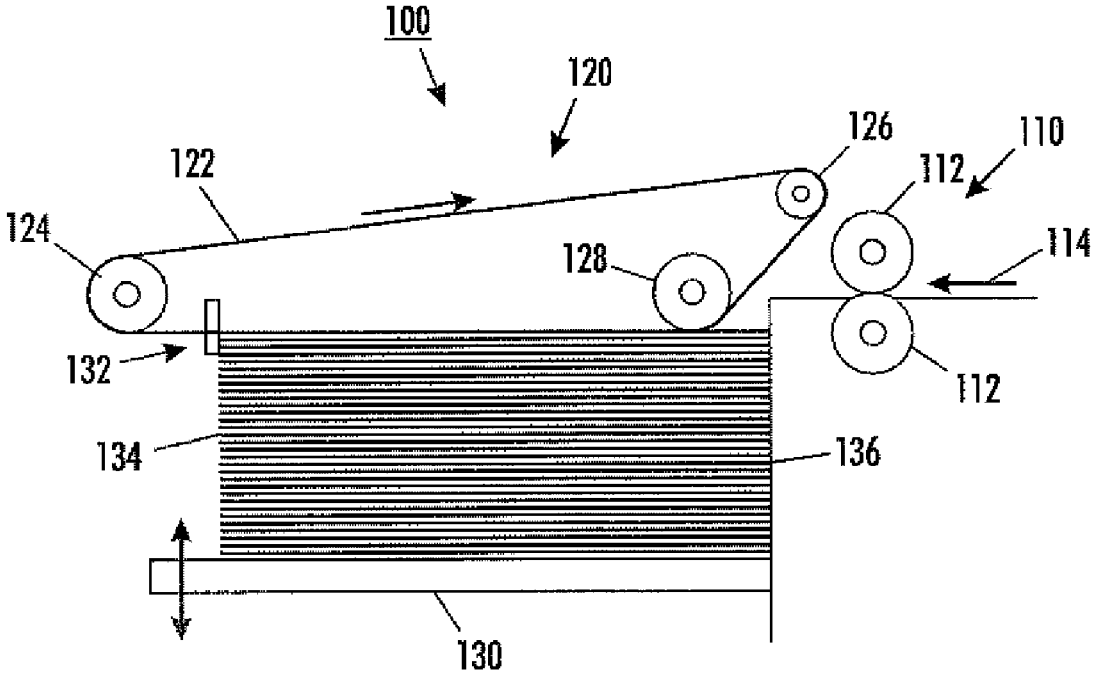
FIG. 1 PRIOR ART
FIG. 1 depicts a side schematic view of a fixed sheet length resilient belt compiler as known in the art.

Reference will now be made in detail to the exemplary embodiments of the invention, examples of which are illustrated in the accompanying drawings. However, one of ordinary skill in the art would readily recognize that the same principles are equally applicable to, and can be implemented in devices other than printers, paper feed, stacking, folding, sorting, and storing devices, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents. Wherever possible, the same reference numbers will be used throughout the drawings to refer to the same or like parts.

Embodiments pertain generally to mixed length sheet compiling, and more particularly to a resilient belt type compiler with a mixed sheet length mode. Although the embodiments are described in connection with structures for paper stacking, it will be appreciated that the feeding of mixed sheet lengths can be used in other devices without departing from the scope of the invention.

In the following, the term "sheet" can include any sheet suitable for stacking in the stacker module, for example various weights and sizes of paper as known in the industry. The terms "lead end" and "trail end" are intended to denote the lead and trail end of any of the sheet, stacking module, sheet inlet, or the like as it relates to a feed direction of the device. In the following, a feed direction is from right to left when viewing the figures. Likewise, the travel direction of the described resilient belt transport is clockwise in the current views of the figures in order to feed the sheets from right to left therein. The term "initial", "first" and "subsequent" refer to a series of sheets fed through the device and their relative order. A subsequent sheet can be a final sheet or followed by a further subsequent sheet according to a total number of sheets fed through the system. In the following, the term "short" can include any length of sheet less than a longest sheet in a feed group.

In the mixed length sheet stacking herein, a selectively actuatable sheet brake is positioned within the resilient belt transport. The actuatable sheet brake is more specifically positioned between adjacent resilient belt belts. A lead edge stop is positioned to accommodate the longest sheet of the mixed length sheets as measured from a trail edge wall of a compiler tray in a sheet stacking module. When a short sheet is transported into the resilient belt transport region, the brake is actuated just as the trail edge of the short sheet aligns with the trail edge wall of the compiler tray. The short sheet is momentarily stalled in this position until a lead end of a subsequent sheet passes the trail edge wall or it is determined that subsequent sheets are absent. The brake then releases to allow the first sheet to advance to the lead edge stop without interference from the subsequent sheet.

FIG. 1 illustrates a side schematic view of a fixed sheet length resilient belt compiler as known in the art.

In the device of FIG. 1, a resilient belt compiler 100 generally includes an inlet transport 110, a resilient belt transport 120, and a vertically biased compiler tray 130. As indicated, this technology can be found in existing cut sheet stacker modules by Hunkeler™, Lasermax/Roll Systems™, and others.

The resilient belt transport 120 of FIG. 1 typically includes a plurality of parallel resilient belts 122 sharing common drive 124, tension 126, and idler 128 rollers. The plurality of resilient belts 122 are driven continuously in a forward direction (clockwise in the figures).

The vertically biased compiler tray 130 is controlled to induce a slight interference with a bottom span of the resilient belts 122. Thus, the top sheet of the stack incurs a net drive force oriented to the left. A lead edge stop 132 is positioned interdigitated with the resilient belts 122 in order to stop a top sheet of the stack 134 at the lead edge stop 132.

The inlet transport 110 can include opposing feed rollers 112. As with the resilient belts 122, the feed rollers 112 can be spaced across a feed direction 114 of a sheet.

As depicted in FIG. 1, an upper level of the sheet stack 134 is significantly below the sheet inlet height 110. This enables successive fixed length sheets to be compiled without their respective lead and trail edges abutting each other. A simple Recurdyn MTT2D™ simulation of this zone has been created and run. The results are depicted in FIGS. 2 and 3.

Figure 2:
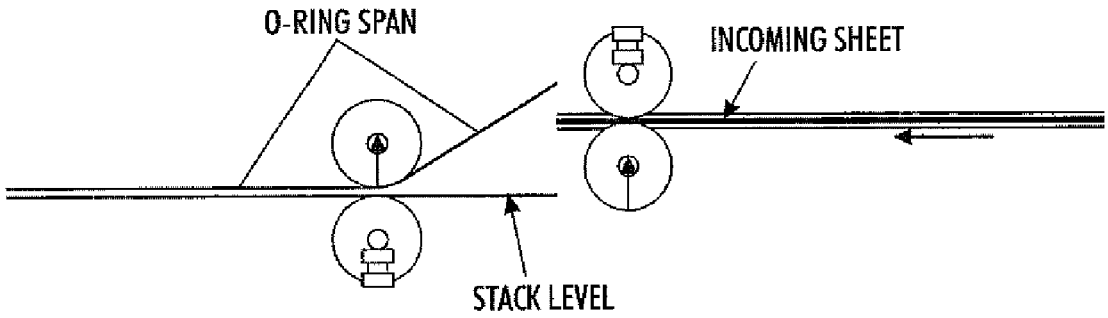
FIG. 2 is a side schematic view depicting a path of an incoming sheet in the device of FIG. 1.

FIG. 2 depicts an initial condition as a sheet prepares to enter the stacking tray of the compiler. FIG. 3 depicts a sheet whose trail edge has just cleared the inlet guide and has "flicked" downward close to the stack level. At this point it is safe for a subsequent sheet to enter the stacking tray of the compiler without a lead end of a subsequent sheet abutting a trail end of a prior sheet.

Figure 3:
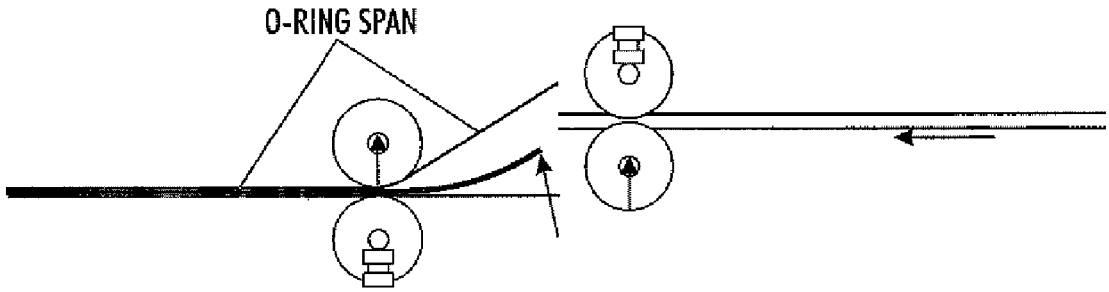
FIG. 3 is a side schematic view depicting a path of a deposited sheet in the device of FIG. 1.

As becomes clear with the model of FIGS. 2 and 3 in relation to FIG. 1, the lead edge stop 132 must be adjusted relative to a fixed trail edge wall 136 so that the relationship of FIG. 3 can exist. The lead edge stop 132 must be positioned such that a lead edge of the sheet can reach the lead edge stop 132 when the sheet is deposited in the compiler tray 130. Otherwise, the trail edge of the top sheet will continue to advance to the left and the lead edge of the subsequent sheet will eventually intercept the trail edge of the prior sheet. This stacking mode works well for its intended purpose of compiled fixed sheet lengths. However, in a mixed sheet length environment, a short sheet will advance to enable a lead edge thereof to contact the lead edge stop, and the trail edge of the shorter sheet will terminate at a distance within the trail edge wall. The lead edge of a subsequent sheet will then collide with the trail edge of the prior short sheet.

Figure 4A:
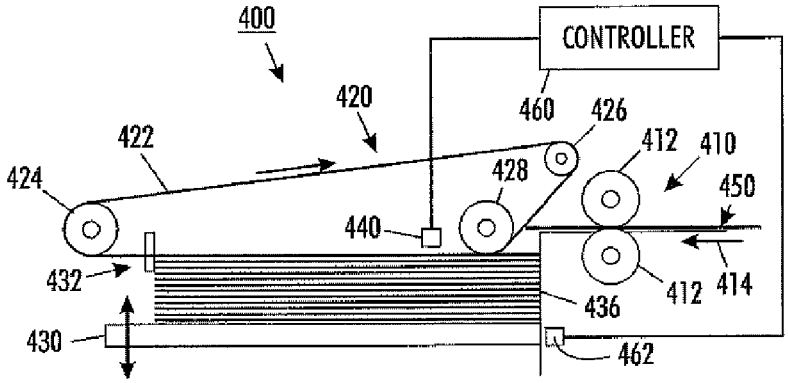
FIGS. 4A-4C are side schematic views illustrating various operational states of an exemplary mixed sheet length resilient belt compiler in accordance with embodiments of the present teachings.
Figure 4B:
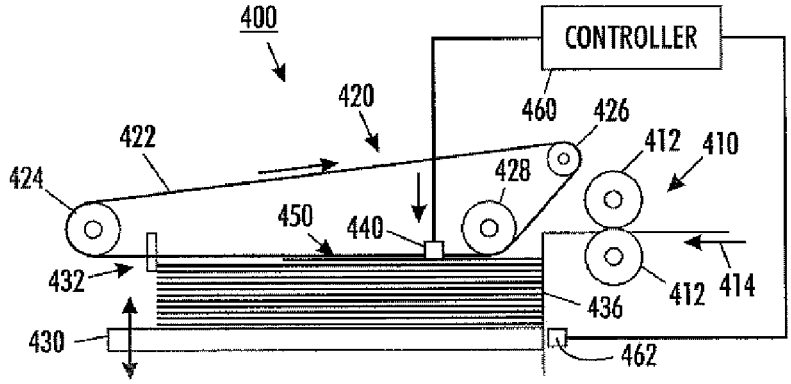
Figure 4C:
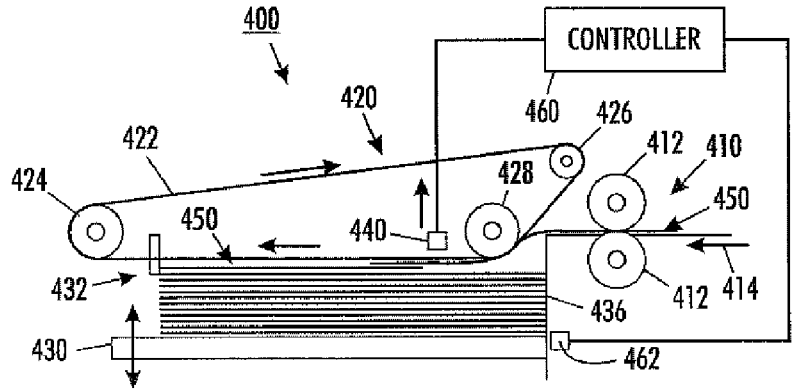

Accordingly, as depicted in FIGS. 4A-4C, the schematic views illustrate various operational states of an exemplary mixed sheet length resilient belt compiler 400 in accordance with embodiments of the present teachings.

Generally, the mixed sheet length resilient belt compiler 400 of FIGS. 4A-4C can include an inlet transport 410, a resilient belt transport 420, and a vertically adjustable compiler tray 430. More specifically, a sheet brake 440 can be provided in connection with the resilient belt transport 420.

The resilient belt transport 420 of FIGS. 4A-4C can include a plurality of parallel resilient belts 422 sharing common drive 424, tension 426, and idler 428 rollers. The resilient belts 422 can be spaced about 1 to 2 inches apart in a direction transverse to a feed direction 414. The resilient belts 422 can be constructed from an elastomer having a high coefficient of friction with respect to a sheet 450. The resilient belts 422 are driven continuously in a forward direction (clockwise in the figures) and at a speed consistent with system timing and an inlet speed of sequential sheets.

The vertically adjustable compiler tray 430 can be controlled to induce a slight interference with a bottom span of the resilient belts 422. Thus, the top sheet of a stack of sheets can incur a net drive force oriented to the left. A lead edge stop 432 is positioned interdigitated with the resilient belts 422 in order to stop a lead edge of the sheet 450 at the lead edge stop 432. If the lead edge of the top sheet 450 is in contact with the lead edge stop 432, then the resilient belts 422 can slip along the top side of the sheet. Because of the low normal force and the low modulus of the resilient belt material, the likelihood of marking or damaging the top surface of the sheet can be controlled. Also, the tendency of lightweight sheets to buckle can be minimized by the constraint imposed by the use of multiple resilient belts 422.

The inlet transport 410 can include opposing feed rollers 412. As with the resilient belt transport 420, the feed rollers 412 can be spaced across a teed direction of the sheet 450. The number and spacing of the feed rollers 412 can be determined according to a type (e.g. weight and size) of sheets being fed during a particular process. As depicted in FIGS. 4A-4C, an upper level of the sheet stack within the compiler tray 430 is significantly below a height of the sheet inlet transport 410.

The sheet brake 440 is positioned in a region of the resilient belt transport 420 and laterally between adjacent resilient belts 422. The sheet brake 440 can be selectively actuated with a solenoid and/or motor, for example, to press against (FIG. 4B) or release from (FIG. 4C) a top sheet within the compiler tray 430.

The sheet brake 440 can be formed of or include one or more high friction surfaces. Although a single sheet brake 440 can be implemented in the system, multiple sheet brakes 440 can be included according to various embodiments. In each case, the sheet brake 440 is interdigitated between adjacent resilient belts 422. By way of further example, the sheet brake 440 can be adjustably positioned to engage with the top sheet just inside a trail edge wall 436 of the shortest expected sheet in a sheet feed/stacking operation. Alternatively, a position of the sheet brake 440 can be substantially mid-length of the shortest expected sheet in a sheet feed/stacking operation.

Control of the sheet brake 440 can be, for example, with a control unit 460 utilizing any variety of sensing/control devices as can be contemplated in the art. For example, the control unit 460 can be an input/output device, with either automatic or manual operation. A monitoring means 462, such as for example a sensor, can be included in or separate from the control unit 460. The sensor 462 can determine a length of a passing sheet, for example by detecting a lead edge, a trail edge or both the lead and trail edge of a passing sheet. Inquiry from the control unit 460 can determine when a trail edge of a short sheet has just cleared the trail edge wall 436. When the trail edge of the short sheet is detected, the brake 440 can be actuated and the short sheet can be stalled to prevent further forward progress in the compiler tray 430. The stalling can be by clamping the brake 440 against the short sheet within the compiler tray 430, as shown in FIG. 4B. As depicted in the figures, the actuation of the brake 440 is perpendicular to a planar surface of the sheets. When the sensor 462 detects that a lead edge of a subsequent sheet has reached the position of the trail edge wall 436, as shown in FIG. 4C, or some fixed distance downstream from the trail edge wall 436, then the brake 440 is released.

The functions of the control unit 460 and sensor 462 have been described in an exemplary manner. However, other interactions and locations thereof are intended to be included within the scope of the exemplary embodiments to the extent that the sheet brake is selectively actuated upon detection of a short sheet entering the compiling tray 430 of the mixed length sheet compiler 400. For example, it is contemplating that more than one sensor and/or control unit can be implemented.

In operation, if a short sheet is detected in the input path, then the sensor 462 can be interrogated to determine when the trail edge of the short sheet has just cleared the trail edge wall 436. When this is detected, the sheet brake 440 can be actuated and the short sheet is effectively stalled in its transport by being clamped to the top of the stack. At this stage, the lead edge of the short sheet has not yet advanced to the lead edge stop 432. In the stalled position, the resilient belt will slip over an upper surface of the short sheet as long as the brake is actuated. When the sensor detects that a lead edge of a subsequent sheet has reached the position of the trail edge wall 436, shown in FIG. 4C, or some fixed distance downstream from the trail edge wall, then the sheet brake 440 can be released. Release of the sheet brake 440 enables the resilient belts to advance the short sheet until its lead edge reaches the lead edge stop 432. At this time, the lead edge of the subsequent sheet then has already "cleared" the trail edge of the short sheet, and it can be compiled as a subsequent sheet on the stack within the compiler tray 430 without any possibility of colliding with the trail edge of the short sheet.

It will be appreciated that when mixed length sheets are to be stacked, the lead edge stop can be positioned to accommodate the longest sheet length within the compiler tray 430.

Although the relationships of components are described in general terms, it will be appreciated by one of skill in the art can add, remove, or modify certain components without departing from the scope of the exemplary embodiments.

It will be appreciated by those of skill in the art that several benefits are achieved by the exemplary embodiments described herein and include cost reduction, a minimally invasive design, retro-fit capabilities for incorporation into existing machines, and provides an option for moving finishing down-market relative to the stacking function.

While the invention has been illustrated with respect to one or more exemplary embodiments, alterations and/or modifications can be made to the illustrated examples without departing from the spirit and scope of the appended claims. In particular, although the method has been described by examples, and particularly the series of events depicted in FIGS. 4A-4C, the steps of the method may be performed in a different order than illustrated or simultaneously. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any an all sub-ranges between (and including) the minimum value of zero and the maximum value of 10, that is, any and all sub-ranges having a minimum value of equal to or greater than zero and a maximum value of equal to or less than 10, e.g., 1 to 5.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A resilient belt sheet compiler, comprising:

a resilient belt transport for sequentially feeding mixed sheet lengths from a sheet inlet to a compiler tray, the compiler tray comprising a lead edge stop and a trail edge wall;

monitoring means, positioned at the trail edge wall of the compiler tray, for monitoring a lead end and a trail end of sequentially fed sheets at the trail edge wall of the compiler tray;

a sheet brake, positioned to physically engage sheets only within the compiler tray and responsive to the monitoring means detecting a short sheet, for selectively stalling a trail end of the detected short sheet within the compiler tray, such that the trail end of the detected short sheet abuts the trail edge wall of the compiler tray until a lead end of a subsequent sheet is detected by the monitoring means or subsequent sheets are absent; and a control system, responsive to the monitoring means, for selectively actuating the sheet brake.

2. The device of claim 1, wherein the sheet brake is positioned directly above the compiler tray.

3. The device of claim 1, wherein a short sheet comprises a sheet length less than a distance between the lead edge stop and the trail edge wall of the compiler tray.

4. A method of stacking mixed sheet lengths in a resilient belt sheet compiler, the method comprising:

providing a resilient belt transport for sequentially stacking sheets received from an inlet transport region into a compiler tray, the compiler tray comprising a lead edge stop and a trail edge wall relative to a sheet feed direction;

providing monitoring means, positioned at the trail edge wall of the compiler tray, to monitor a lead end and a trail end of sequentially fed sheets at the trail edge wall of the compiler tray;

determining a length of a received sheet via the monitoring means; and stalling a trail end of a monitored short sheet from within the compiler tray such that the trail end of the monitored short sheet abuts the trail edge wall of the compiler tray until a lead edge of subsequent sheet from the inlet transport is detected by the monitoring means at the trail edge wall of the compiler tray.

5. The method of claim 4, wherein stalling comprises applying a sheet brake to a top sheet in the compiler tray.

6. The method of claim 5, further comprising releasing the sheet brake upon arrival of the lead edge of the subsequent sheet at the trail end wall.

7. The method of claim 4, wherein the monitoring means comprises a sheet sensor in an inlet transport region of the resilient belt sheet compiler.

8. The method of claim 5, further comprising a control system, responsive to the monitoring means, for selectively actuating the sheet brake.

* * * * *